US006434760B1

(12) United States Patent
Montalvo

(10) Patent No.: US 6,434,760 B1
(45) Date of Patent: Aug. 20, 2002

(54) PRESSURIZED PLUNGER APPARATUS

(76) Inventor: Ruben Montalvo, 301 W. Jersey St., Apt 205, Elizabeth, NJ (US) 07202

( * ) Notice: Subject to any disclaimer, the term of this patent is extended or adjusted under 35 U.S.C. 154(b) by 0 days.

(21) Appl. No.: 09/922,149

(22) Filed: Aug. 3, 2001

(51) Int. Cl.[7] ..... E03D 9/00
(52) U.S. Cl. ..... 4/255.05; 4/255.06
(58) Field of Search ..... 4/255.04, 255.05, 4/255.06, 255.08, 255.09, 255.01, 255.02, 255.03, 255.11, 255.12; D32/35

(56) References Cited

U.S. PATENT DOCUMENTS

| | | | | | |
|---|---|---|---|---|---|
| 1,734,206 | A | * | 11/1929 | Fisch | 4/255.05 |
| 2,430,739 | A | * | 11/1947 | Scott | 4/255.05 |
| 2,490,422 | A | * | 12/1949 | Denison | 4/255.06 |
| 4,063,317 | A | | 12/1977 | Santore | |
| 4,768,237 | A | * | 9/1988 | Torti | 4/255.05 |
| 4,790,356 | A | | 12/1988 | Tash | |
| 4,847,923 | A | * | 7/1989 | Huang | 4/255.06 |
| 5,239,708 | A | | 8/1993 | Irwin | |
| 5,384,918 | A | * | 1/1995 | Leighton et al. | 4/255.05 |
| 5,524,296 | A | * | 6/1996 | Leighton | 4/255.05 |
| 5,669,099 | A | | 9/1997 | Porcasi | |
| 5,803,101 | A | * | 9/1998 | Gallo | 4/255.06 |
| D404,178 | S | | 1/1999 | Wetzler | |
| 5,940,897 | A | | 8/1999 | James | |
| 5,974,596 | A | | 11/1999 | Strzok | |
| 6,185,755 | B1 | * | 2/2001 | Shepherd et al. | 4/255.06 |

FOREIGN PATENT DOCUMENTS

| | | | | |
|---|---|---|---|---|
| DE | 2213236 | * | 9/1973 | 4/255.08 |
| DE | 3838978 | * | 5/1990 | 4/255.04 |

* cited by examiner

*Primary Examiner*—Charles R. Eloshway

(57) ABSTRACT

A pressurized plunger apparatus for cleaning drains and other plumbing fixtures of obstacles. The pressurized plunger apparatus includes a pressurizable handle assembly that has an air valve for releasing the compressed air into a chamber area of a plunger member when the device is depressed onto a drain, thereby forcing the compressed air into the plumbing system and clearing the debris.

4 Claims, 2 Drawing Sheets

PRESSURIZED PLUNGER APPARATUS

BACKGROUND OF THE INVENTION

1. Field of the Invention

The present invention relates to plungers and more particularly pertains to a new pressurized plunger apparatus for cleaning drains and other plumbing fixtures of obstacles.

2. Description of the Prior Art

The use of plungers is known in the prior art. More specifically, plungers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,669,099; U.S. Pat. No. 5,239,708; U.S. Pat. No. 5,940,897; U.S. Pat. No. 5,974,596; U.S. Pat. No. 4,063,317; U.S. Pat. No. 4,790,356; and U.S. Pat. No. Des. 404,178.

While these devices fulfill their respective, particular objectives and requirements, the aforementioned patents do not disclose a new pressurized plunger apparatus. The inventive device includes a pressurizable handle assembly that has an air valve for releasing the compressed air into a chamber area of a plunger member when the device is depressed onto a drain, thereby forcing the compressed air into the plumbing system and clearing the debris.

In these respects, the pressurized plunger apparatus according to the present invention substantially departs from the conventional concepts and designs of the prior art, and in so doing provides an apparatus primarily developed for the purpose of cleaning drains and other plumbing fixtures of obstacles.

SUMMARY OF THE INVENTION

In view of the foregoing disadvantages inherent in the known types of plungers now present in the prior art, the present invention provides a new pressurized plunger apparatus construction wherein the same can be utilized for cleaning drains and other plumbing fixtures of obstacles.

The general purpose of the present invention, which will be described subsequently in greater detail, is to provide a new pressurized plunger apparatus apparatus and method which has many of the advantages of the plungers mentioned heretofore and many novel features that result in a new pressurized plunger apparatus which is not anticipated, rendered obvious, suggested, or even implied by any of the prior art plungers, either alone or in any combination thereof.

To attain this, the present invention generally comprises a pressurizable handle assembly that has an air valve for releasing the compressed air into a chamber area of a plunger member when the device is depressed onto a drain, thereby forcing the compressed air into the plumbing system and clearing the debris.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pressurized plunger apparatus apparatus and method which has many of the advantages of the plungers mentioned heretofore and many novel features that result in a new pressurized plunger apparatus which is not anticipated, rendered obvious, suggested, or even implied by any of the prior art plungers, either alone or in any combination thereof.

It is another object of the present invention to provide a new pressurized plunger apparatus which may be .easily and efficiently manufactured and marketed.

It is a further object of the present invention to provide a new pressurized plunger apparatus which is of a durable and reliable construction.

An even further object of the present invention is to provide a new pressurized plunger apparatus which is susceptible of a low cost of manufacture with regard to both materials and labor, and which accordingly is then susceptible of low prices of sale to the consuming public, thereby making such pressurized plunger apparatus economically available to the buying public.

Still yet another object of the present invention is to provide a new pressurized plunger apparatus which provides in the apparatuses and methods of the prior art some of the advantages thereof, while simultaneously overcoming some of the disadvantages normally associated therewith.

Still another object of the present invention is to provide a new pressurized plunger apparatus for cleaning drains and other plumbing fixtures of obstacles.

Yet another object of the present invention is to provide a new pressurized plunger apparatus which includes a pressurizable handle assembly that has an air valve for releasing the compressed air into a chamber area of a plunger member when the device is depressed onto a drain, thereby forcing the compressed air into the plumbing system and clearing the debris.

Still yet another object of the present invention is to provide a new pressurized plunger apparatus that amplifies the capabilities of traditional plungers by making one push of the handle equal sever pushes of regular plungers.

Even still another object of the present invention is to provide a new pressurized plunger apparatus that is suitable for use on toilets, sinks and other drains.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
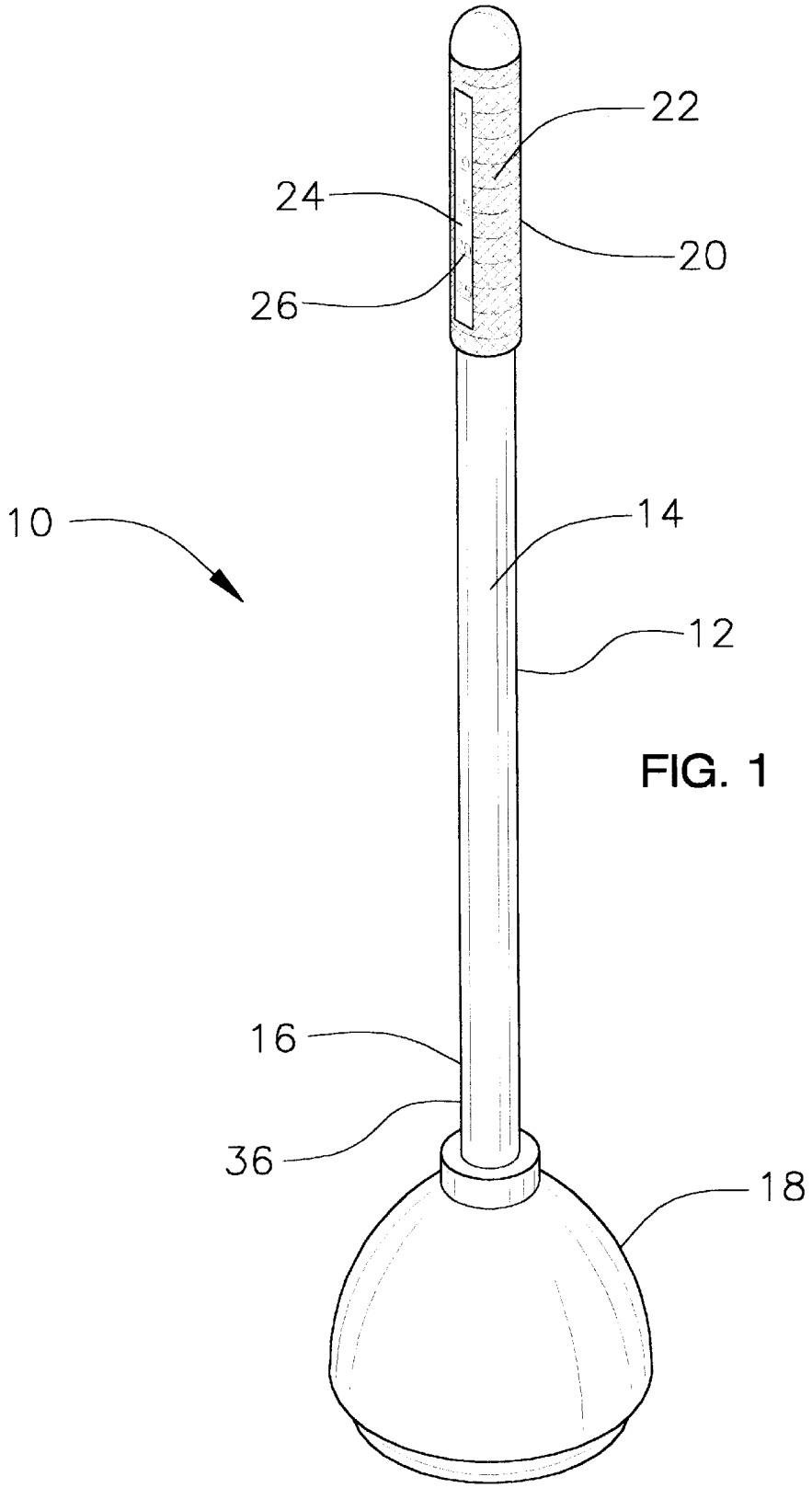
FIG. 1 is a perspective view of a new pressurized plunger apparatus according to the present invention.
Figure 2:
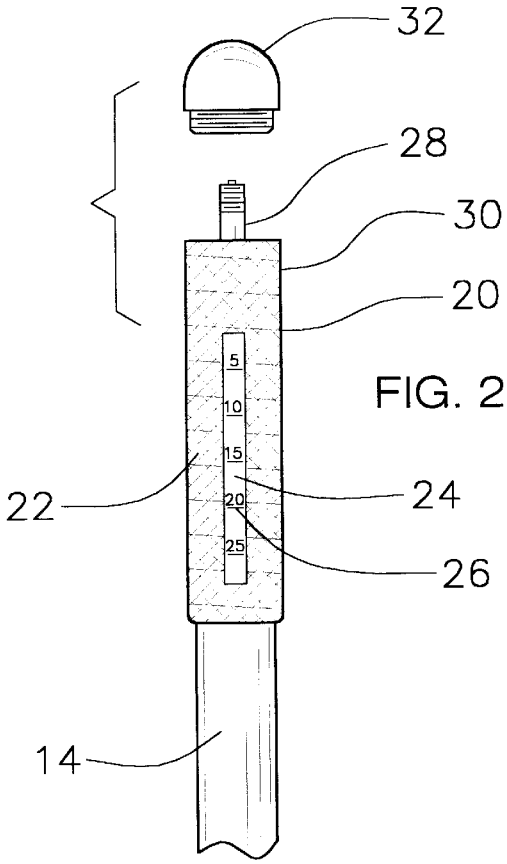
FIG. 2 is an exploded view of the top end of the present invention.
Figure 3:
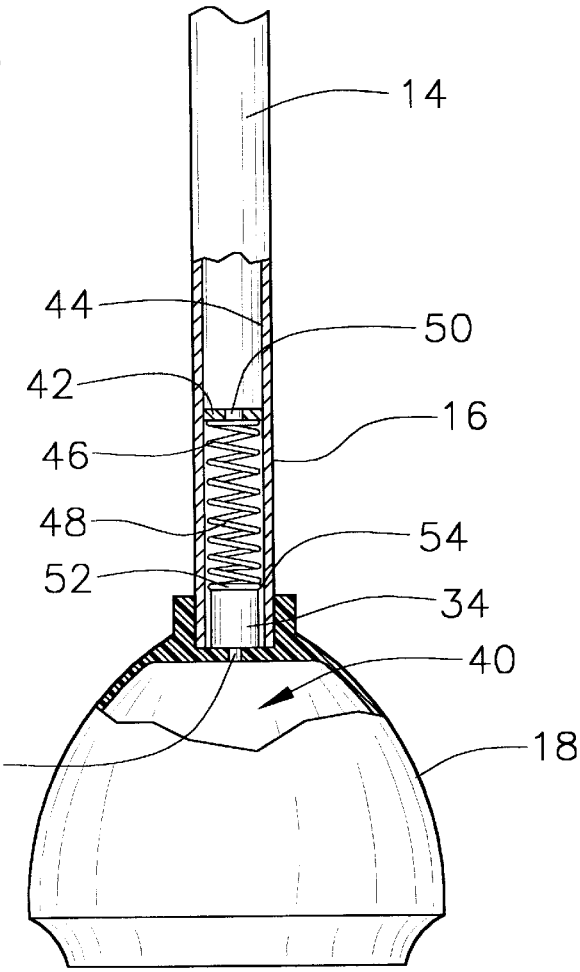
FIG. 3 is a partial cross-sectional view of the bottom end of the present invention.

With reference now to the drawings, and in particular to FIGS. 1 through 3 thereof, a new pressurized plunger apparatus embodying the principles and concepts of the present invention and generally designated by the reference numeral 10 will be described.

As best illustrated in FIGS. 1 through 3, the pressurized plunger apparatus 10 generally comprises a pressurizable handle assembly 12. The pressurizable handle assembly 12 comprises a tubular cylinder assembly 14, designed for containing pressurized air.

A bottom end 16 of the tubular cylinder assembly 14 is fixedly coupled to a plunger member 18. The plunger member 18 is of a rubberized conventional design such that the plunger member 18 is designed for encompassing drains or the like for the purpose of clearing debris caught in a section of the drain thereby clearing out the plumbing system when the plunger member 18 is manually depressed onto the drain and the pressurized air is forced into the plumbing system.

A top end 20 of the tubular cylinder assembly 14 includes a grip portion 22. The grip portion 22 comprises a rubberized material such that the grip portion 22 is designed for grasping onto by a user.

The grip portion 22 has a gauge member 24. The gauge member 24 has indicia 26 positioned along a longitudinal axis of the tubular cylinder assembly 14. The gauge member 24 is designed for indicating the internal air pressure inside the tubular cylinder assembly 14.

The top end 20 of the tubular cylinder assembly 14 includes an air intake valve member 28. The air intake valve member 28 is fixedly coupled to a proximal end 30 of the tubular cylinder assembly 14. The air intake valve member 28 is designed for being selectively coupled to a pressurized air hose thereby pressurizing the tubular cylinder assembly 14.

The top end 20 of the tubular cylinder assembly 14 includes a cap member 32. The cap member 32 is threadably couplable to the proximal end 30 of the grip member of the top end 20. The cap member 32 is designed for enclosing the air intake valve member 28.

The bottom end 16 of the tubular cylinder assembly 14 includes an air output valve member 34. The air output valve member 34 is positioned proximate a distal end 36 of the tubular cylinder assembly 14. The air output valve member 34 is designed for releasing pressurized air through an air pressure aperture 38 into a chamber area 40 of the plunger member 18 when the tubular cylinder assembly 14 is manually depressed downwardly onto a drain such that the compressed air in the tubular cylinder assembly 14 is released into the chamber area 40 of the plunger member 18, thus the drain, thereby moving the debris and unclogging the plumbing system.

The bottom end 16 of the tubular cylinder assembly 14 includes an intermediate wall member 42. The intermediate wall member 42 is fixedly coupled to an internal wall 44 of the tubular cylinder assembly 14 proximate the distal end 36 of the tubular cylinder assembly 14. The intermediate wall member 42 is designed for abutting an upper end of a biasing member 46.

The intermediate wall member 42 has a bore 50. The bore 50 is designed for allowing the pressurized air in the tubular cylinder assembly 14 to pass through to the air output valve member 34.

A lower end 52 of the biasing member 46 of the tubular cylinder assembly 14 abuts a top surface 54 of the air output valve member 34 such that the biasing member 46 is designed for downwardly maintaining the air output valve member 34 in a closed position until the tubular cylinder assembly :14 is manually depressed thereby releasing the compressed air in the tubular cylinder assembly 14 into the chamber area 40 of the plunger member 18 when the plunger member 18 is fully depressed onto the drain.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pressurized plunger apparatus for cleaning drains and other plumbing fixtures of obstacles, the pressurized plunger apparatus comprising:

a pressurizable handle assembly, said pressurizable handle assembly comprising a tubular cylinder assembly for containing pressurized air; and a plunger member fixedly coupled to a bottom end of said tubular cylinder assembly, said plunger member comprising a rubberized material for encompassing drains for clearing debris out of the drain when said plunger member is manually depressed over the drain and the pressurized air is forced into the drain;

a top end of said tubular cylinder assembly including a grip portion, said grip portion comprising a rubberized material such that said grip portion being adapted for grasping onto by a user;and said top end of said tubular cylinder assembly includes a cap member, said cap member being threadably couplable to said proximal end of said grip portion, said cap member being adapted for enclosing said air intake valve member;

wherein said top end of said tubular cylinder assembly includes an air intake valve member, said air intake valve member being fixedly coupled to a proximal end of said top end, said air intake valve member being adapted for being selectively coupled to a pressurized air hose to thereby supply pressurized air into said tubular cylinder assembly.

2. The pressurized plunger apparatus as set forth in claim 1, wherein said bottom end of said tubular cylinder assembly includes an air output valve member, said air output valve member being positioned proximate a distal end of said tubular cylinder assembly, said air output valve member being adapted for releasing pressurized air through an air pressure aperture into a chamber area of said plunger member.

3. The pressurized plunger apparatus as set forth in claim 2, wherein said bottom end of said tubular cylinder assembly includes an intermediate wall member, said intermediate wall member being fixedly coupled to an internal wall of said tubular cylinder assembly proximate said distal end of said tubular cylinder assembly, said intermediate wall member being adapted for abutting an upper end of a biasing member; and said intermediate wall member having a bore, said bore being adapted for allowing the pressurized air in said tubular cylinder assembly to pass through to said air output valve member.

4. The pressurized plunger apparatus as set forth in claim 3, wherein a lower end of said biasing member of said tubular cylinder assembly abuts a top surface of said air output valve member such that said biasing member is adapted for downwardly maintaining said air output valve member in a closed position.

* * * * *